US008334250B2

(12) United States Patent
Murkunde et al.

(10) Patent No.: US 8,334,250 B2
(45) Date of Patent: Dec. 18, 2012

(54) METHOD OF MAKING GRANULAR DETERGENT COMPOSITIONS COMPRISING AMPHIPHILIC GRAFT COPOLYMERS

(75) Inventors: Rohan Govind Murkunde, Morpeth (GB); Sarah Jane Melville, New Castle Upon Tyne (GB); Malcolm McClaren Dodd, Tyne & Wear (GB); Stefan James Egan, Tyne & Wear (GB); Christopher Charles Driffield, New Castle Upon Tyne (GB); Andrew Brian Greenaway Patton, County Durham (GB)

(73) Assignee: The Procter & Gamble Company, Cincinnati, OH (US)

( * ) Notice: Subject to any disclaimer, the term of this patent is extended or adjusted under 35 U.S.C. 154(b) by 166 days.

(21) Appl. No.: 12/641,390

(22) Filed: Dec. 18, 2009

(65) Prior Publication Data

US 2011/0152160 A1 Jun. 23, 2011

(51) Int. Cl.
*C11D 11/00* (2006.01)
*C11D 11/02* (2006.01)
*C11D 3/37* (2006.01)

(52) U.S. Cl. ..... 510/444; 510/443; 510/452; 510/475

(58) Field of Classification Search ..... 510/444, 510/443, 452, 475
See application file for complete search history.

(56) References Cited

U.S. PATENT DOCUMENTS

| | | | | |
|---|---|---|---|---|
| 4,746,456 | A | 5/1988 | Kud et al. | |
| 4,846,994 | A | 7/1989 | Kud et al. | |
| 5,049,302 | A | 9/1991 | Holland et al. | |
| 5,635,554 | A | 6/1997 | Boeckh et al. | |
| 5,733,856 | A | 3/1998 | Gopalkrishnan et al. | |
| 6,358,910 | B1 * | 3/2002 | Boskamp et al. | 510/446 |
| 7,163,985 | B2 | 1/2007 | Ortiz et al. | |
| 7,465,701 | B2 | 12/2008 | Sharma et al. | |
| 2003/0224025 | A1 | 12/2003 | Gotsche et al. | |
| 2006/0270582 | A1 | 11/2006 | Boeckh et al. | |
| 2008/0300158 | A1 | 12/2008 | Schutz et al. | |
| 2009/0005287 | A1 | 1/2009 | Boutique et al. | |
| 2009/0005288 | A1 | 1/2009 | Boutique et al. | |
| 2009/0023625 | A1 | 1/2009 | Tang et al. | |
| 2009/0291875 | A1 | 11/2009 | Lant et al. | |
| 2009/0298735 | A1 | 12/2009 | Boeckh et al. | |

FOREIGN PATENT DOCUMENTS

| | | | |
|---|---|---|---|
| EP | 0285038 | A2 | 10/1988 |
| EP | 0358474 | A2 | 3/1990 |
| GB | 2304726 | A | 3/1997 |

OTHER PUBLICATIONS

Int'l Search Report—5 Pages, PCT/US2010/059157 dated May 2, 2011.

* cited by examiner

*Primary Examiner* — Lorna M Douyon
(74) *Attorney, Agent, or Firm* — Melissa G. Krasovec; Steven W. Miller

(57) ABSTRACT

A process of making a granular detergent composition comprising amphiphilic graft copolymer. The granular detergent composition may have an L-3b value of at least about 73.5.

4 Claims, No Drawings

METHOD OF MAKING GRANULAR DETERGENT COMPOSITIONS COMPRISING AMPHIPHILIC GRAFT COPOLYMERS

FIELD OF THE INVENTION

The present invention is directed to methods of making granular detergent compositions containing amphiphilic graft copolymers.

BACKGROUND OF THE INVENTION

In addition to surfactants, polymers are utilized as soil detachment-promoting additives in laundry detergents. These polymers may be suitable for use in the laundry liquor as dispersants of soil pigments such as clay minerals or soot, and/or as additives which prevent the reattachment of soil to the fabric being laundered. However, these polymeric dispersants may be ineffective in the removal of hydrophobic soil from textiles, particularly when they are utilized under low temperature washing conditions.

The amphiphilic graft copolymers described in USPN 2009/0005288A1 and 2009/0005287A1 are particularly suited for the removal of hydrophobic soil from fabric in the wash liquor. Consequently, it would be very desirable to provide a granular laundry detergent composition comprising such polymers. However, previous attempts to incorporate amphiphilic graft copolymers have led to the discoloration of the resulting granular detergent compositions.

Consumers may associate the cleaning power of a granular detergent composition with its appearance. For this reason, it may be disadvantageous to market a detergent in which some or all of the granules are discolored. Yet it can be costly to remove and/or mask the discolored granules through additional processing steps and/or through the addition of further components to the detergent (such as titanium dioxide for example). The additional cost can be undesirable for both the detergent manufacturer and consumer.

Thus there is currently a need to provide a granular detergent composition that is suited for removing hydrophobic soil and that has a consumer acceptable appearance. Moreover there is a need for a method of making such a granular detergent composition without incurring substantial cost to mask any discoloration. There is particularly a need for a method of making a granular detergent composition in which no substantial discoloration of the amphiphilic polymers occurs.

SUMMARY OF THE INVENTION

The present invention addresses the aforementioned needs by providing the following method of making a granular detergent composition.

In one embodiment, the process of making a granular detergent composition comprises the steps of: a. forming an aqueous detergent slurry comprising: detersive surfactant; alkalinity source; and at least one additional detergent ingredient; b. spray drying the aqueous detergent slurry to form a plurality of spray-dried detergent particles; and c. adding amphiphilic graft copolymer to at least a portion of the plurality of spray-dried detergent particles.

In one embodiment, the process of making a granular detergent composition comprises the steps of: a. forming an aqueous detergent slurry comprising by weight percentage of the aqueous detergent slurry of: from above 0% to about 40% detersive surfactant; from above 0% to about 15% polymeric component selected from the group of: polymeric carboxylate; polyester soil release agent; cellulosic polymer; and mixtures thereof; from above 0% to 10% chelant; from above 0% to 40% filler salt; and from about 3% to about 40% alkalinity source; b. spray drying the aqueous detergent slurry to form a plurality of spray-dried detergent particles; and c. adding amphiphilic graft copolymer to at least a portion of the plurality of spray-dried detergent particles. The amphiphilic graft copolymer comprises a graft copolymer of polyethylene, polypropylene or polybutylene oxide with vinyl acetate in a weight ratio of from about 1:0.2 to about 1:10.

In some embodiments, the granular detergent composition that is made has an L-3b value of at least about 73.5.

DETAILED DESCRIPTION OF THE INVENTION

As used herein, "consisting essentially of" means that the composition or component may include additional ingredients, but only if the additional ingredients do not materially alter the basic and novel characteristics of the claimed compositions or methods.

All percentages, parts and ratios are based upon the total weight of the composition of the present invention and all measurements made are at 25° C., unless otherwise specified. All such weights as they pertain to listed ingredients are based on the active level and therefore do not include carriers or by-products that may be included in commercially available materials, unless otherwise specified.

Granular laundry detergents may be manufactured using a spray drying process. The spray drying process typically includes spraying an aqueous slurry comprising detergent ingredients into a spray-drying tower through which hot air flows. As it falls through the tower, the aqueous slurry forms droplets, the hot air causes water to evaporate from the droplets, and a plurality of spray-dried granules is formed. The resulting granules may form the finished granular detergent composition. Alternatively, the resulting granules may be further processed (such as via agglomeration) and/or further components (such as detergent adjuncts) may be added thereto.

However, the inventors have found that when certain polymers such as amphiphilic graft copolymer(s) (hereinafter "AGP(s)") are spray-dried with other detergent ingredients, the resulting spray-dried powder has a consumer undesirable yellow hue. The yellowing can be especially problematic in detergent matrices having high alkalinity and/or that are processed under high temperature conditions. Without wishing to be bound by theory, it is believed that the discoloration of the granules results from the occurrence of one or more chemical reactions with the AGP(s) as it is subjected to the conditions in the tower. Such reactions may include:

a. Chain degradation reaction through oxidation may occur at the level of the polymer PEG backbone;

b. Dehydration of the vinyl acetate/alcohol functionalities can lead to formation of double bonds in the hydrophobic side chains;

c. Hydrolysis reactions may occur at the vinyl acetate functionalities of the hydrophobic side chains; and/or d. Residuals (monomer residue) may form acetaldehyde & acetate.

Surprisingly, the granular detergent compositions according to the present invention comprise AGP(s) and are not discoloured. The compositions, their characteristics and the process of making them are discussed below.

Composition

I. Aqueous Slurry

An aqueous slurry is prepared using any suitable method. For example, the aqueous slurry may be prepared by mixing detergent ingredients together in a crutcher mixer. The aqueous slurry may comprise: (1) detersive surfactant; (2) alkalinity source; and (3) at least one additional detergent ingredient. The aqueous slurry may contain water at a weight percentage of from about 25 wt % to about 50 wt %.

(1) Detersive Surfactant

Any suitable detersive surfactant is of use in the aqueous slurry. The aqueous slurry typically comprises from above 0 wt % to about 30 wt % detersive surfactant, preferably from about 10 wt % to about 20 wt % detersive surfactant.

Suitable detersive surfactants include, but are not limited to: anionic surfactants, non-ionic surfactants, cationic surfactants, zwitterionic surfactants, amphoteric surfactants and any mixtures thereof. Preferred surfactants include anionic surfactants, cationic surfactants, non-ionic surfactants and any mixtures thereof.

Anionic Surfactants:

The anionic detersive surfactant preferably comprises alkyl benzene sulphonate, preferably the anionic detersive surfactant comprises at least 50 wt %, at least 55 wt %, at least 60 wt %, at least 65 wt %, at least 70 wt %, at least 75 wt %, at least 80 wt %, at least 85 wt %, at least 90 wt %, or even at least 95 wt %, by weight of the anionic detersive surfactant, of alkyl benzene sulphonate. The alkyl benzene sulphonate is preferably a linear or branched, substituted or unsubstituted, $C_{8-18}$ alkyl benzene sulphonate. This is the optimal level of the $C_{8-18}$ alkyl benzene sulphonate to provide a good cleaning performance. The $C_{8-18}$ alkyl benzene sulphonate can be a modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548. Highly preferred $C_{8-18}$ alkyl benzene sulphonates are linear $C_{10-13}$ alkylbenzene sulphonates. Especially preferred are linear $C_{10-13}$ alkylbenzene sulphonates that are obtainable by sulphonating commercially available linear alkyl benzenes (LAB); suitable LAB include low 2-phenyl LAB, such as those supplied by Sasol under the trade name Isochem® or those supplied by Petresa under the trade name Petrelab®. Other suitable LAB include high 2-phenyl LAB, such as those supplied by Sasol under the trade name Hyblene®.

The anionic detersive surfactant may preferably comprise other anionic detersive surfactants. A suitable anionic detersive surfactant is a non-alkoxylated anionic detersive surfactant. The non-alkoxylated anionic detersive surfactant can be an alkyl sulphate, an alkyl phosphate, an alkyl phosphonate, an alkyl carboxylate or any mixture thereof. The non-alkoxylated anionic surfactant can be selected from the group consisting of; $C_{10}$-$C_{20}$ primary, branched-chain, linear-chain and random-chain alkyl sulphates (AS), typically having the following formula (I):

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

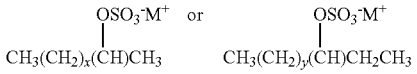

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl carboxylates; mid-chain branched alkyl sulphates as described in more detail in U.S. Pat. Nos. 6,020,303 and 6,060,443; methyl ester sulphonate (MES); alpha-olefin sulphonate (AOS); and mixtures thereof.

Another preferred anionic detersive surfactant is an alkoxylated anionic detersive surfactant. The presence of an alkoxylated anionic detersive surfactant in the spray-dried powder provides good greasy soil cleaning performance, gives a good sudsing profile, and improves the hardness tolerance of the anionic detersive surfactant system. It may be preferred for the anionic detersive surfactant to comprise from 1% to 50%, or from 5%, or from 10%, or from 15%, or from 20%, and to 45%, or to 40%, or to 35%, or to 30%, by weight of the anionic detersive surfactant system, of an alkoxylated anionic detersive surfactant.

Preferably, the alkoxylated anionic detersive surfactant is a linear or branched, substituted or unsubstituted $C_{12-18}$ alkyl alkoxylated sulphate having an average degree of alkoxylation of from 0.5 to 30, preferably from 0.5 to 10, more preferably from 0.5 to 3. Preferably, the alkoxylated anionic detersive surfactant is a linear or branched, substituted or unsubstituted $C_{12-18}$ alkyl ethoxylated sulphate having an average degree of ethoxylation of from 0.5 to 10, more preferably from 0.5 to 3. Most preferably, the alkoxylated anionic detersive surfactant is a linear unsubstituted $C_{12-18}$ alkyl ethoxylated sulphate having an average degree of ethoxylation of from 0.5 to 7, more preferably from 0.5 to 3.

The alkoxylated anionic detersive surfactant, when present with an alkyl benzene sulphonate may also increase the activity of the alkyl benzene sulphonate by making the alkyl benzene sulphonate less likely to precipitate out of solution in the presence of free calcium cations. Preferably, the weight ratio of the alkyl benzene sulphonate to the alkoxylated anionic detersive surfactant is in the range of from 1:1 to less than 5:1, or to less than 3:1, or to less than 1.7:1, or even less than 1.5:1. This ratio gives optimal whiteness maintenance performance combined with a good hardness tolerance profile and a good sudsing profile. However, it may be preferred that the weight ratio of the alkyl benzene sulphonate to the alkoxylated anionic detersive surfactant is greater than 5:1, or greater than 6:1, or greater than 7:1, or even greater than 10:1. This ratio gives optimal greasy soil cleaning performance combined with a good hardness tolerance profile, and a good sudsing profile.

Suitable alkoxylated anionic detersive surfactants are: Texapan LEST™ by Cognis; Cosmacol AES™ by Sasol; BES151™ by Stephan; Empicol ESC70/U™; and mixtures thereof.

Preferably, the anionic detersive surfactant comprises from 0% to 10%, preferably to 8%, or to 6%, or to 4%, or to 2%, or even to 1%, by weight of the anionic detersive surfactant, of unsaturated anionic detersive surfactants such as alpha-olefin sulphonate. Preferably the anionic detersive surfactant is essentially free of unsaturated anionic detersive surfactants such as alpha-olefin sulphonate. By "essentially free of" it is typically meant "comprises no deliberately added". Without wishing to be bound by theory, it is believed that these levels of unsaturated anionic detersive surfactants such as alpha-olefin sulphonate ensure that the anionic detersive surfactant is bleach compatible.

Preferably, the anionic detersive surfactant comprises from 0% to 10%, preferably to 8%, or to 6%, or to 4%, or to 2%, or even to 1%, by weight of alkyl sulphate. Preferably the anionic detersive surfactant is essentially free of alkyl sulphate. Without wishing to be bound by theory, it is believed that these levels of alkyl sulphate ensure that the anionic detersive surfactant is hardness tolerant.

Non-ionic Surfactants:

Suitable non-ionic detersive surfactant can be selected from the group of: $C_8$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 30, as described in more detail in U.S. Pat. Nos. 6,153,577, 6,020,303 and U.S. Pat. No. 6,093,856; alkylpolysaccharides as described in more detail in U.S. Pat. No. 4,565,647, specifically alkylpolyglycosides as described in more detail in U.S. Pat. Nos. 4,483,780 and 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

(2) Alkalinity Source

Any suitable alkalinity source is of use in the aqueous slurry. Suitable alkalinity sources include, but are not limited to being selected from the group of: carbonate salt; silicate salt; sodium hydroxide; and mixtures thereof. Useful amounts of an alkalinity source include from about 1 to about 20% or from about 1 to about 10% of alkalinity source by weight of the composition. Exemplary alkalinity sources may be selected from the group of: sodium carbonate; sodium silicate; and mixtures thereof.

(3) Additional Detergent Ingredients

Builder:

Any suitable builder may be of use in the aqueous slurry. Suitable builders include, but are not limited to those selected from the group of: zeolite builder; phosphate builder; and mixtures thereof. Non-limiting examples of useful zeolite builders include: zeolite A; zeolite X; zeolite P; zeolite MAP; and combinations thereof. Sodium tripolyphosphate is a non-limiting example of a useful phosphate builder. The zeolite builder(s) may be present at from about 1 to about 20% by weight of the detergent composition.

Polymers:

Any polymer suitable builder may be of use in the aqueous slurry. Suitable polymers include, but are not limited to: polymeric carboxylate; polyester soil release agent; cellulosic polymer; and mixtures thereof. One preferred polymeric material is a polymeric carboxylate, such as a co-polymer of maleic acid and acrylic acid. However, other polymers may also be suitable, such as polyamines (including the ethoxylated variants thereof), polyethylene glycol and polyesters. Polymeric soil suspending aids and polymeric soil release agents are also particularly suitable.

Another suitable polymer is cellulosic polymer, such as cellulosic polymer selected from the group of: alkyl alkoxy cellulose, preferably methyl hydroxyethyl cellulose (MHEC); alkyl cellulose, preferably methyl cellulose (MC); carboxy alkyl cellulose, preferably carboxymethylcellulose (CMC); and mixtures thereof.

Polymers may be present at from about 0.5 to about 20% or from about 1 to about 10% by weight of the detergent composition.

Other Detergent Ingredients:

Other suitable detergent ingredients may be selected from the group of: chelants such as ethylene diamine disuccinic acid (EDDS); hydroxyethylene diphosphonic acid (HEDP); starch; sodium sulphate; carboxylic acids such as citric acid or salts thereof such as citrate; suds suppressor; fluorescent whitening agent; hueing agent; flocculating agent such as polyethylene oxide; and mixtures thereof. If the present detergent comprises masking agents and/or whiteners (e.g. Titanium dioxide), they may be present at less than about 1 wt % or less.

II. Amphiphilic Graft Copolymer(s)

AGP(s) of use in the present invention are described and claimed in USPN 2009/0005288A1 and 2009/0005287A1. They are obtainable by grafting a polyalkylene oxide of number average molecular weight from about 2,000 to about 100,000 with vinyl acetate, which may be partially saponified, in a weight ratio of polyalkylene oxide to vinyl acetate of about 1:0.2 to about 1:10. The vinyl acetate may, for example, be saponified to an extent of up to 15%. The polyalkylene oxide may contain units of ethylene oxide, propylene oxide and/or butylene oxide. Selected embodiments comprise ethylene oxide.

In some embodiments the polyalkylene oxide has a number average molecular weight of from about 4,000 to about 50,000, and the weight ratio of polyalkylene oxide to vinyl acetate is from about 1:0.5 to about 1:6. A material within this definition, based on polyethylene oxide of molecular weight 6,000 (equivalent to 136 ethylene oxide units), containing approximately 3 parts by weight of vinyl acetate units per 1 part by weight of polyethylene oxide, and having itself a molecular weight of about 24,000, is commercially available from BASF as Sokalan™ HP22.

Selected embodiments of the AGP(s) of use in the present invention as well as methods of making them are described in detail in PCT Patent Application No. WO 2007/138054. They may be present in the granular detergent compositions of the present invention at weight percentages from about 0 to about 5%, from about 0% to about 4%, or from about 0.5% to about 2%. In some embodiments, the AGP(s) is present at greater than about 1.5%. The AGP(s) are found to provide excellent hydrophobic soil suspension even in the presence of cationic coacervating polymers.

The AGP(s) are based on water-soluble polyalkylene oxides as a graft base and side chains formed by polymerization of a vinyl ester component. These polymers having an average of less than or equal to one graft site per 50 alkylene oxide units and mean molar masses ($M_w$) of from about 3000 to about 100,000.

Characteristics

Blown Powder Whiteness:

The blown powder whiteness of a granular detergent can be measured using a HunterLab Color difference meter and following appropriate operating procedure. Various models of the HunterLab Color difference meter can be used, such as the HunterLab LabScan XE or HunterLab Model D25. Care is taken to make sure that the powder sample is free of lumps and is representative of the overall particle size. The readings are taken at ambient temperature.

A HunterLab color difference meter is used to characterize color of a sample into three different parameters according to the Hunter L, a, b color scale. In this scale, the differences between points plotted in a color space correspond to visual differences between the colors plotted. The Hunter L, a, b color scale is organized in cube form. The L axis of the cube runs from top to bottom. The maximum for L is 100, which would be a perfect reflecting diffuser. The minimum for L would be zero, which would be black. The a and b axes of the cube have no specific numerical limits. Positive a is red. Negative a is green. Positive b is yellow. Negative b is blue.

The "L-3b" (L minus 3b) value signifies the whiteness of the sample. The whiteness of a blown powder according to the present invention is at least about 73.5.

Equilibrium pH:

Granular detergent compositions according to the present invention may be characterized by an equilibrium pH value. Equilibrium pH value is measured as follows. 4 grams of granular detergent composition is dissolved in one liter of deionized water. pH is measured at a temperature of 20° C.

Granular detergent compositions according to the present invention may have an equilibrium pH of less than about 12 at 20° C.

Blown Granule Properties:

The following properties may describe blown granular detergents of the present invention.

Bulk Density:

Blown granular detergent compositions according to the present invention may have a bulk density of from about 250 to about 550 grams per liter, or from about 300 to about 450 grams per liter.

Particle Size Distribution:

Blown granular detergent compositions according to the present invention may have a mean particle granule size of from about 300 to about 550 microns, or from about 350 to about 450 microns.

Cake Strength:

Blown granular detergent compositions according to the present invention may have a cake strength of less than about 2 kgf, or less than about 1 kgf.

Process of Making

Granular detergent compositions comprising AGP(s) per the present invention may be manufactured using any suitable process. The AGP(s) may be added to the spray-dried powder, and/or the AGP(s) may be incorporated into the detergent composition in the form of a dry-added particle, such as an agglomerate or extrudate, that is separate and chemically distinct from the spray-dried powder. AGP(s) may be incorporated in liquid form by being sprayed onto particulate components of the composition.

If the AGP(s) is included in the spray-dried powder, it may be incorporated into the aqueous slurry along with the other detergent ingredients.

A portion or all of the AGP(s) may be sprayed onto the granules once they are removed from the crutcher.

In one embodiment of the invention, the process of making a granular detergent composition comprising AGP(s) may comprise the following steps:

a. forming an aqueous detergent slurry comprising: detersive surfactant; alkalinity source; and at least one additional detergent ingredient;
b. spray drying said aqueous detergent slurry to form a plurality of spray-dried detergent particles; and
c. adding AGP(s) to at least a portion of said plurality of spray-dried detergent particles.

In step (c), the AGP(s) may be in solid form, such as in the form of a dry-added particle, such as an agglomerate or extrudate that is separate and chemically distinct from the spray-dried powder. Alternatively, the AGP(s) may be in liquid form, being incorporated by a spray-on process step, i.e. the AGP(s) liquid being sprayed onto particulate components of the composition, such as the spray-dried detergent particles.

EXAMPLE 1

In one embodiment of the invention, a granular detergent comprising AGP(s) is made as follows. Using a 73% active AGP polymer solution, a 23% active agglomerate can be made by using the standard agglomeration process. Table I shows typical composition of an agglomerate containing AGP(s).

TABLE I

| Raw Material | Composition (%) |
|---|---|
| Zeolite | 20.00 |
| AGP(s) | 23.00 |
| Sodium Carbonate | 48.50 |
| Miscellaneous and water | To 100 |

Running a Dual Lodige agglomeration process (high speed pin mixers such as CB-30 mixer followed by a ploughshare mixer such as KM-600 mixer) at 600 Kg/hr total production rate, AGP(s) is added via open pipe nozzles into the pin mixer at 189 Kg/hr at 60° C. With the pin mixer running at 1800 rpm (Tip speed 28 m/s) the AGP(s) is mixed at high shear with the ground sodium carbonate and 11 parts of the total zeolite. The remaining 9 pts zeolite are used for dusting in the ploughshare mixer, grinder and onto the final AGP agglomerate.

The 23% active AGP agglomerate may be added at 3-4% to finished granule composition to deliver 0.7-0.9% active AGP(s) in the finished product.

EXAMPLE 2

In another embodiment of the present invention, a finished granular detergent composition comprising AGP(s) has the following Finished Product formula:

TABLE II

| Constituent | % Weight |
|---|---|
| BLOWN POWDER | |
| Linear Alkyl Benzene Sulphonate | 11.00 |
| Silicate | 5.00 |
| Polymeric carboxylate | 2.50 |
| MgSO4 | 0.80 |
| Na Carbonate | 10.00 |
| Na Sulphate | 15.00 |
| Chelant | 0.80 |

TABLE II-continued

| Constituent | % Weight |
|---|---|
| ADMIX | |
| Citric Acid | 1.50 |
| NaCarbonate | 10.00 |
| Percarbonate | 22.00 |
| TAED | 5.00 |
| Na Sulphate | Balance |
| Spray on | |
| Non ionic surfactant | 1.0 |
| AGP(s) | 2.0 |

Non-ionic and AGP(s) are sprayed onto the blown powder and admixed in a mix drum.

In all embodiments of the present invention, all percentages are by weight of the total composition, unless specifically stated otherwise. All ratios are weight ratios, unless specifically stated otherwise. All ranges are inclusive and combinable. The number of significant digits conveys neither a limitation on the indicated amounts nor on the accuracy of the measurements. Unless otherwise indicated, all measurements are understood to be made at 25° C. and at ambient conditions, where "ambient conditions" means conditions under about one atmosphere of pressure and at about 50% relative humidity. All such weights as they pertain to listed ingredients are based on the active level and do not include carriers or by-products that may be included in commercially available materials, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making a granular detergent composition having an L-3b value of at least about 73.5, said process consisting of the steps of:

a. forming an aqueous detergent slurry comprising by weight percentage of said aqueous detergent slurry:
   i. from above 10% to about 20% detersive surfactant;
   ii. from above 0% to about 15% polymeric component selected from the group of: polymeric carboxylate; polyester soil release agent; cellulosic polymer; and mixtures thereof;
   iii. from above 0% to 10% chelant;
   iv. from above 0% to 40% filler salt;
   v. from about 3% to about 40% alkalinity source; and
   vi. from about 1% to about 20% zeolite;
b. spray drying said aqueous detergent slurry to form a plurality of spray-dried detergent particles;
c. separately agglomerating an amphiphillic graft copolymer with zeolite and sodium carbonate in a high speed mixer to form an agglomerate, said amphiphilic graft copolymer comprising a graft copolymer of polyethylene, polypropylene or polybutylene oxide with vinyl acetate in a weight ratio of from about 1:0.2 to about 1:10; and
d. adding said agglomerate to at least a portion of said plurality of spray-dried detergent particles.

2. The process according to claim 1, wherein said detersive surfactant is selected from the group of: alkyl benzene sulfonate; alkoxylated alkyl sulfate; alkyl sulfate; alkoxylated alcohol; and mixtures thereof.

3. The process according to claim 1, wherein said alkalinity source is selected from the group of: carbonate salt; silicate salt; sodium hydroxide; and mixtures thereof.

4. A process of making a granular detergent composition having an L-3b value of at least about 73.5, said process consisting of the steps of:

a. forming an aqueous slurry comprising by weight percentage of said aqueous slurry:
   i. from above 0% to about 20% surfactant selected from the group of: alkyl benzene sulfonate; alkoxylated alkyl sulfate; alkyl sulfate; alkoxylated alcohols; and mixtures thereof;
   ii. from about 1% to about 8% polymeric builder selected from at least one polymeric carboxylate; and
   iii. from about 0.5% to about 25% alkalinity source selected from the group of: carbonate salt; silicate salt; sodium hydroxide; and mixtures thereof;
b. spray drying said aqueous slurry to form a plurality of spray dried detergent particles;
c. separately agglomerating an amphiphilic graft copolymer with zeolite and sodium carbonate in a high speed mixer to form an agglomereate, said amphiphilic graft copolymer comprising a graft copolymer of polyethylene, polypropylene or polybutylene oxide with vinyl acetate in a weight ratio of from about 1:0.2 to about 1:10; and
d. adding said agglomerate to at least a portion of said plurality of spray-dried detergent particles.

* * * * *